United States Patent [19]

Chambers

[11] Patent Number: 4,572,481

[45] Date of Patent: Feb. 25, 1986

[54] RELEASABLE CLAMPING ASSEMBLY FOR USE WITH HYDRAULIC JACKING APPARATUS

[76] Inventor: Henry B. Chambers, 1040 Debra Dr., Santa Barbara, Calif. 93110

[21] Appl. No.: 311,413

[22] Filed: Oct. 14, 1981

[51] Int. Cl.[4] ..... B66F 1/00

[52] U.S. Cl. ..... 254/106

[58] Field of Search ..... 269/105–108, 269/29 R, 29 A, 35–37, 285, 203

[56] References Cited

U.S. PATENT DOCUMENTS

| | | | |
|---|---|---|---|
| 2,444,304 | 6/1948 | Miller | 269/285 |
| 3,373,971 | 3/1968 | Chambers et al. | 254/107 |
| 3,441,265 | 4/1969 | Albert | 269/203 |
| 4,030,699 | 6/1977 | Heimke | 254/108 |

*Primary Examiner*—Robert C. Watson

*Attorney, Agent, or Firm*—Daniel J. Meaney, Jr.

[57] ABSTRACT

A hydraulic apparatus is shown for moving a heavy load along an I-beam shaped structural member comprising a releasable clamping assembly and a double acting hydraulic jacking cylinder. The releasable clamping assembly includes a ramp plate, a pair of ramp mating members and a pair of jaw members having a cavity defined by opposed sloped walls having a bearing surface which cooperate with a ramp plate and ramp mating members causing the gripping surface of the ramp plate and ramp mating members to engage the flange of an I-beam. The releasable clamping assembly transmits a thrust load from a jacking cylinder thrust to the jaw member which reacts to apply a clamping force to the ramp plate and ramp mating members such that a thrust load away from direction of load travel will result in the ramp plate and the pair of ramp mating plates being urged towards each other to grip the flanged surface of the I-beam and arrest the motion of the jacking cylinder relative to the I-beam. The releasable clamping assembly is responsive to a very small thrust load in the direction of travel to move the ramp plate and ramp mating members apart from one another allowing the jacking cylinder and clamping assembly to be repositioned. Gripping lugs extending from the jacking cylinder to the flange of the I-beam transmit part of the rotational movement directly to the I-beam to permit the use of a small size jacking cylinder.

6 Claims, 13 Drawing Figures

RELEASABLE CLAMPING ASSEMBLY FOR USE WITH HYDRAULIC JACKING APPARATUS

BACKGROUND OF THE INVENTION

1. Field of the Invention

This invention relates generally to a jacking apparatus for advancing a heavy load along an I-beam. As commonly arranged, a heavy load rests on two parallel I-beams and a pair of jacking devices, one on each I-beam, is arranged to advance the load, either by sliding it or rolling it on the I-beam. More particularly, this invention relates to a releasable clamping assembly which is responsive to a thrust load to mechanically urge a ramp plate, with a gripping surface, and a pair of opposed ramp mating members, each of which have gripping surface towards each other and into contact with the flanges of an I-beam which holds the releasable clamping member in a gripping relationship against the I-beam flange during application of the thrust force.

2. Description of the Prior Art

It is known in the art to utilize hydraulic apparatus including a jacking assembly to move a heavy load along an I-beam or other flanged member.

Specific prior art is disclosed in U.S. Pat. Nos. 3,373,971; Re. 26,905; 3,464,095; 3,559,954; and 4,007,915. Generally, the hydraulic apparatus shown in the art comprise a double acting hydraulic jack working in cooperation with a slot and latch assembly or a hydraulic clamping assembly. The latch and slot assembly or hydraulic clamping assembly mechanically grip the flange of an I-beam. Engagement of a latch in a slot formed in the I-beam or the hydraulic clamping assembly against the I-beam flange provides a temporary load path into the rail or support against which the heavy load from the jacking cylinder can react when applying force to the heavy load. The latch assembly or hydraulic clamping assembly is successively unlocked and repositioned and/or advanced to a new working location after each power stroke of the jacking cylinder. Typical applications of such jacking devices is for moving oil derricks on offshore platforms and for moving ships or ship sections in shipyards during construction or repair. Weights to be moved range from hundred of tons to many thousands of tons and the jacking forces needed, range from hundreds of tons to thousands of tons.

The known hydraulic clamping assemblies and latching asesmblies for accomplishing the above are described in the above referenced United States Patents.

Specifically, the hydraulic gripper for the derrick jack disclosed in U.S. Pat. Nos. 3,373,971 and Re. 26,905, wherein the inventor of the present invention was named in both U.S. Patents as one of the co-inventors, utilizes a hydraulic motor for developing the clamping force which moves or rotates side plates to drive jaws into gripping engagement with the bottom of an I-beam flange and which urges the top surface thereof against trunnion pins. The hydraulic clamping assembly reacts with the thrust force produced by a jacking apparatus to move a heavy load along the I-beam.

The hydraulic gripper and moving jack disclosed in U.S. Pat. No. 3,559,954, wherein the inventor of the present invention was named as one of the co-inventors, utilizes a hydraulic cylinder to generate the clamping force and a pair of rotatable jaw-like plates and shoes to grip the top and bottom of the I-beam to hold the hydraulic clamping assembly in fixed position against the I-beam to react with the thrust force produced by the jacking apparatus to move a heavy load along the I-beam.

U.S. Pat. No. 3,464,095 wherein the inventor of the present invention was the named inventor, discloses a hydraulic clamping mechanism utilizing a flattened tube lying inside of a "C" shaped chamber of a channel shaped gripper member wherein fluid is pumped under pressure into the tube pressing the channel shaped gripper member into gripping engagement with the I-beam to hold the same in fixed position during application of a thrust force thereagainst.

U.S. Pat. No. 4,007,915, wherein the inventor of the present invention was the named inventor, discloses a latching mechanism which cooperates with preformed slots in the flange of the I-beam to hold the hydraulic assembly in fixed position during application of a thrust force thereagainst.

U.S. Pat. No. 2,621,892 discloses a railroad car moving jack having a hydraulic actuated cylinder which operates a claxping assembly having a fixed clamp member and a moveable clamp member which forms a vise-like clamping assembly to grip the sides of a flanged member of a railroad track in response to a clamping force applied therebetween by the hydraulic cylinder.

The use of a vertical rotary holding table fixture, which rotates a bowl having an inwardly sloping center which receives and supports casing slips to grasp, hold and rotate well casings is likewise known in the art. Such devices are sold by Varco Corporation and are known as VARCO CMS-XL casing slips or VARCO SDML rotary slips.

SUMMARY OF THE INVENTION

The present invention discloses a novel, unique and improved releasable clamping assembly for use with a hydraulic jacking apparatus. In the preferred embodiment, the releasable clamping assembly is adapted to engage a flange member having a pair of opposed peripheral edges. The releasable clamping assembly utilizes a ramp plate having a flange contacting surface which includes a first elongated means for gripping one peripheral edge of the flanged member. The ramp plate includes means for defining an opposed, sloping outer surface which extends at a preselected angle relative to the first elongated means to form a wedge having a small end and a large end. The releasable clamping assembly includes one or more ramp mating members having a flange contacting surface which includes a second elongated means for gripping the other peripheral edge of the flange member. The ramp mating member has an opposed sloping outer surface which extends at the preselected angle relative to the second elongated means to form a wedge having a small end and a large end. The ramp plate and the ramp mating member are adapted to be positioned relative to the pair of peripheral edges of the flange member such that the first elongated means is in contact with the one peripheral edge and the second elongated means is in contact with the other peripheral edge. The small end of the ramp plate and the small end of the ramp mating plate is positioned in opposed spaced alignment relative to each other and with the corresponding large ends thereof positioned in opposed spaced alignment relative to each other. The ramp plate and ramp mating member are adapted to be responsive to a clamping force concurrently applied to the respective outer surfaces to securely grip its associated peripheral edge. The releasable clamping assembly further includes at least one jaw assembly which includes means for defining a cavity in the center thereof wherein the cavity is adapted to receive the opposed, spaced aligned ramp plate and ramp mating member having therebetween that portion of the flanged member having its opposed peripheral edges in contact with the first elongated means and second elongated means. The jaw assembly includes means for defining a pair of spaced opposed sloping walls having a bearing surface formed thereon and wherein the spaced opposed walls are substantially parallel to and slidably engage the outer surface of the ramp plate and the outer surface of the ramp mating member. The jaw assembly is responsive to a thrust force applied thereto at the end thereof contiguous the opposed small ends of the ramp plate and the ramp mating member and in a direction substantially parallel to the opposed peripheral edges of the flanged member to urge the bearing surface defining the cavity against the outer surfaces of the ramp plate and the ramp mating member applying a clamping force thereto causing the first elongated means and the second elongated means to securely grip the opposed peripheral edges during application of the thrust force to hold the clamping assembly in a fixed position against the pair of opposed peripheral edges of the flange member.

Current successful manufacturers of known hydraulic apparatus including hydraulic clamping assemblies and jacking apparatus, sold for the purposes described herein, employ designs of clamping devices which are heavy and complex. To generate the clamping forces, certain of the known apparatus employ hydraulic means secondary to a jacking cylinder to move clamping members relative to each other to grip the flanged member. The effective hydraulic working area of such hydraulic clamping assemblies is several times larger than the working area of the hydraulic jacking cylinder. Both the weight and the cost of the hydraulic clamping apparatus far exceed the weight and cost of the jacking cylinder.

Similarly, certain of the known designs for latching mechanisms utilized to react with the jacking apparatus result in heavy and bulky components which are necessary to accomodate large rotational force couples created by reacting with the thrust force because the plane of thrust of the jacking cylinder is several inches above the I-beam flange. Thus, the latch mechanism structure or housing into which jacking thrust is reacted, must have the mechanical structure and size to react with this large rotational force couple.

One advantage of the present invention is that the releasable clamping assembly can be utilized with any known hydraulic jacking means to react the thrust force generated thereby into a flanged member such as for example, an I-beam, a railroad rail or the like.

Another advantage of the present invention is that the releasable clamping assembly can be used interchangeably with the I-beams of known latching means and hydraulic clamping means in a given jacking system enabling a user to have a hybrid hydraulic jacking system comprising hydraulic clamping assemblies, latching assemblies and releasable clamping assemblies.

A further advantage of the present invention is that the releasable clamping assembly will accomodate inaccuracies in the I-beam fabrication.

A still further advantage of the present invention is that the releasable clamping assembly can be utilized to grip a flanged member on the top and bottom peripheral surfaces, such as the top and bottom of an I-beam or to grip a flanged member on the side peripheral surfaces, such as the edges of a railroad rail, or to grip any other flanged member having opposed peripheral outer surfaces.

A yet further advantage of the present invention is that the magnitude of the clamping force applied to the ramp plates and ramp mating member to grip the peripheral edge of the flanged member can be controlled by selecting the preselected angle of the wedge and slope of the cavity walls.

Yet a further advantage of the present invention is that once the releasable clamping assembly is reacted to a thrust force causing the ramp plate and ramp mating member to grip the flanged member, the ramp plate and ramp mating members can be easily released by a small force applied thereto in a direction opposite to the thrust force. When the ramp plate and ramp mating members are released from their gripping engagement with the flanged member, the clamping assembly can be repositioned for a subsequent thrust force application.

A still yet further advantage of the present invention is that the releasable clamping assembly can be coupled with a known type of commercial hydraulic jacking cylinder having a tie-rod construction. Typically such known hydraulic jacking cylinders comply with JIC specifications which are known in the industry. Such hydraulic jacking cylinders are widely available from a variety of manufacturers, are of standard catalog dimensions, are available in a variety of sizes and any given size and model is interchangeable from one manufacturer to another.

A still yet further advantage of the present invention is that load translating members such as guide lugs, may be used to couple the rotational force couple generated by a jacking cylinder directly into an I-beam flange which permits the use of a smaller jacking cylinder and the use of either a releasable clamping assembly or latching assembly.

BRIEF DESCRIPTION OF THE DRAWING

The foregoing and other advantages of this invention will be apparent from the following description of the preferred embodiment of the invention when considered with the illustrations and the accompanying drawing which includes the following Figures.

DESCRIPTION OF THE PREFERRED EMBODIMENT

Figure 1:
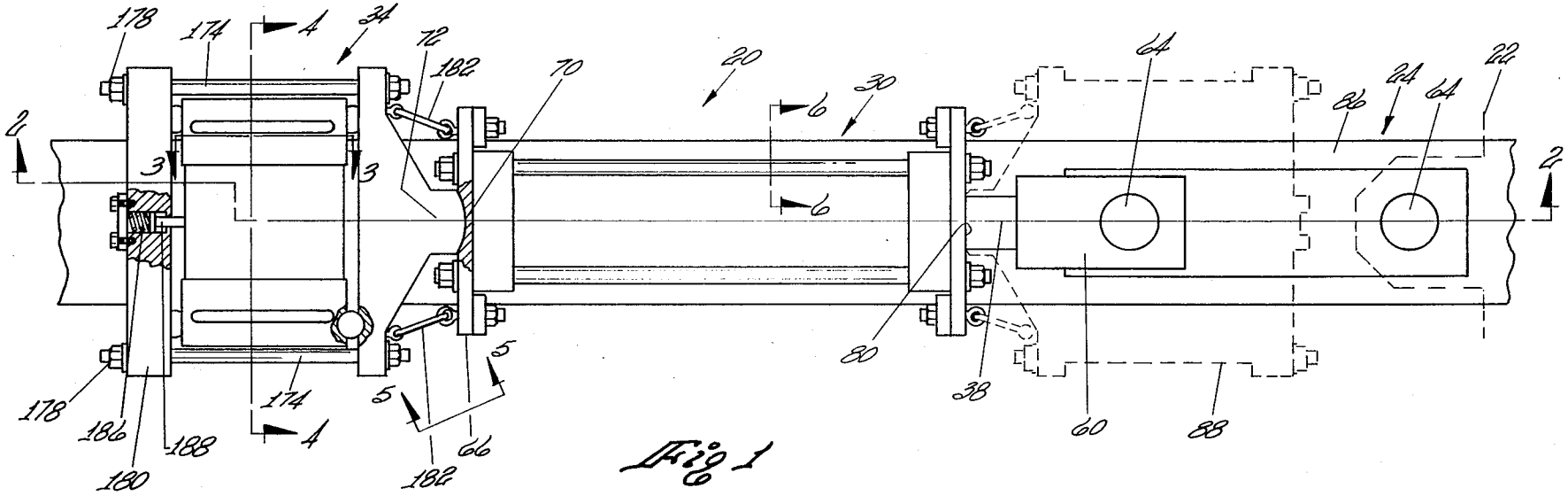
FIG. 1 is a top plan view of a hydraulic jacking apparatus having a jacking cylinder in combination with the releasable clamping assembly of the present invention for reacting the jacking cylinder thrust into an I-beam.
Figure 2:
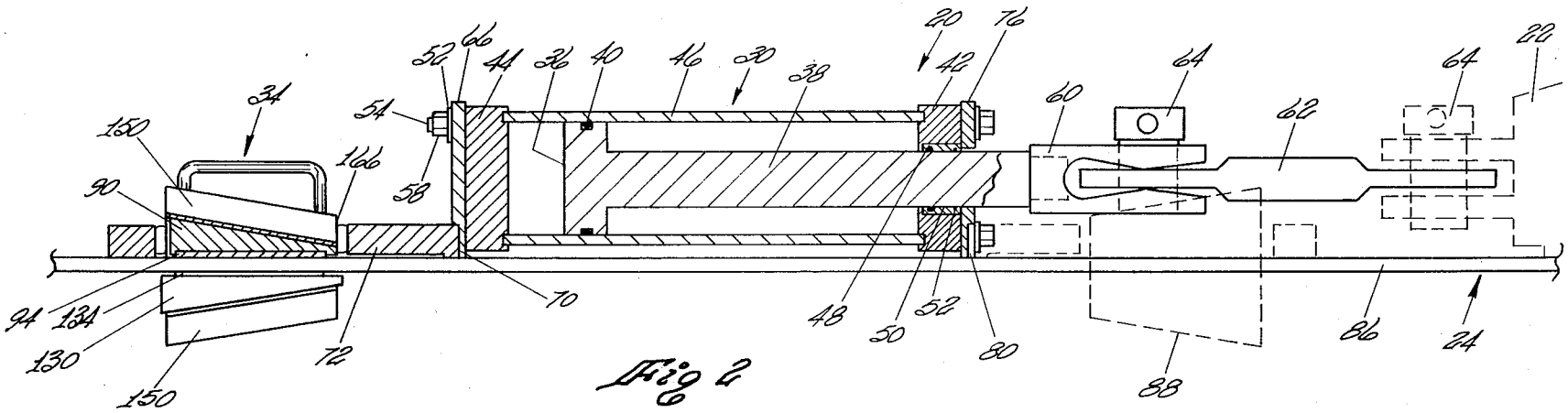
FIG. 2 is a sectional view, taken along section lines 2—2 of FIG. 1.

FIGS. 1 and 2 illustrate a hydraulic apparatus shown generally as 20, for moving a heavy load 22 along an I-beam 24. The hydraulic apparatus 20 includes a jacking cylinder 30 and a releasable clamping assembly 34. The releasable clamping assembly 34 is capable of reacting the thrust from jacking cylinder 30 into I-beam 24.

As shown in FIG. 2, the jacking cylinder 30 is of conventional construction having a piston 36, piston rod 38, piston seal 40, rod end cap 42, blind end cap 44, cylinder body 46, rod seal 48, rod bearing 50, rod scraper 52 and tie rods 54 having washers 56 and nuts 58.

The piston rod 38 has one end connected to piston 36 and has its other end passing through the rod end cap 42 such that the rod seal 48, rod bearing 50 and rod scraper 52 engage the periphery thereof and permit the piston rod 30 to slidably move therethrough. The other end of piston rod 38 terminates in a rod end 60.

Outboard of and adjacent the blind end cap 44 is a mounting flange 66 having a radiused or arcuate shaped recess 70 in its lower section which acts as a receiver for a mating surface of a thrust plate 72 which extends therefrom to the releasable clamping assembly 34.

Outboard of rod end cap 42 is a second mounting flange 76 having radiused or arcuate shaped recess 80 identical to arcuate shaped recess 70 for receiving the mating surface of a thrust plate 72, which would be in turn, positioned between the releasable clamping assembly 34 when located in the alternate position 88 shown in dashed lines. In FIGS. 1 and 2, the releasable clamping assembly 34 is positioned for pushing the heavy load 22 and reacting the same into flange 86 of I-beam 24. In the alternative, the releasable clamping assembly, when located in the alternate position 88, is arranged for pulling the heavy load 22.

Figure 3:
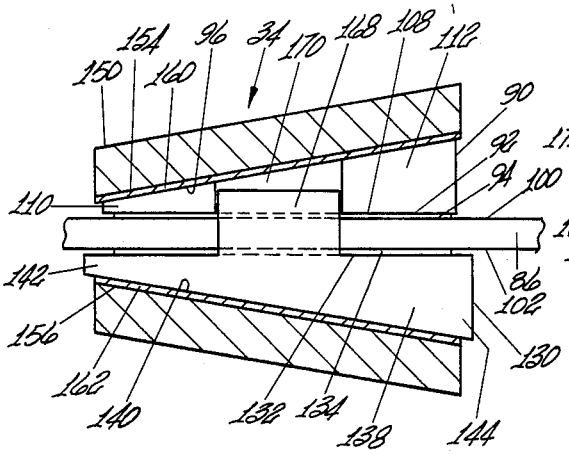
FIG. 3 is a rotated sectional view taken along section lines 3—3 of FIG. 1.
Figure 4:
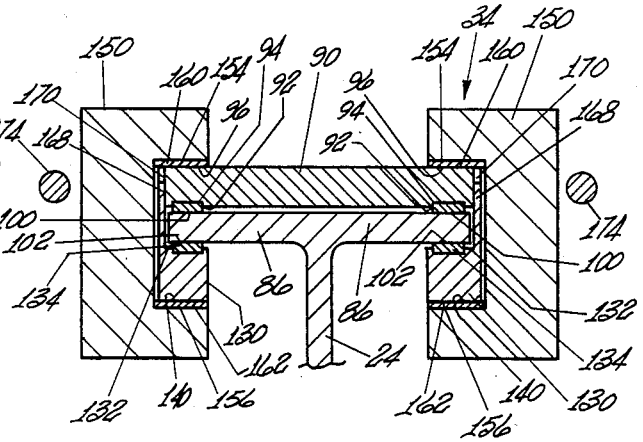
FIG. 4 is a sectional view taken along section lines 4—4 of FIG. 3.

The preferred embodiment of the releasable clamping assembly 34 is illustrated, generally in FIG. 2 and in greater detail in FIGS. 3 and 4. The releasable clamping assembly 34 is adapted to engage a flanged member, such as for example, the flange member 86 of I-beam 24. The flanged member 86 has two separate pairs of opposed peripheral edges 100 and 102, one on each side of the flange 86. In the preferred embodiment illustrated in FIGS. 2, 3 and 4, one side of the flanged member 86 is gripped on the top surface 100 which is considered one peripheral edge, and on the bottom surface 102 which is considered the other peripheral edge.

The releasable clamping assembly 34 includes a ramp plate 90 having a flange contacting surface 92 which includes therewith a first elongated means 94 for gripping the one peripheral edge 100 of the flanged member 86. The ramp plate 90 includes means 96 for defining an opposed sloping outer surface extending at a preselected angle relative to the first elongated means 94 to form a wedge having a small end 110 and a large end 112.

Each ramp mating member 130 has a flange contacting surface 132 including a second elongated means 134 for gripping the upper peripheral edge 102 of the flanged member 86. The ramp mating member 130 has an opposed sloping outer surface 140 extending at the preselected angle relative to the second elongated means 134 to form a wedge having a small end 142 and a large end 144. The ramp plate 90 and the ramp mating member 130 are adapted to be positioned relative to the pair of peripheral edges 100 and 102, respectively, of the flanged member 86 with the first elongated means 94 in contact with the one peripheral edge 100 and the second elongated means 134 in contact with the other peripheral edge 102. The ramp plate 90 and the ramp mating member 130 are positioned relative to each other such that the small end 110 of ramp plate 90 and the small end 142 of the ramp mating member 130 are positioned in opposed spaced alignment relative to each other and with the corresponding large ends 112 and 144, respectively, positioned in opposed spaced alignment relative to each other. The ramp plate 90 and the ramp mating member 130 are adapted to be responsive to a clamping force concurrently applied to their respective outer surfaces 96 and 140 to securely grip their associated peripheral edges 100 and 102, respectively.

A jaw assembly member 150 includes means for defining a cavity in the center thereof, which cavity is defined by opposed sloping sidewalls 154 and 156. The cavity is adapted to receive the opposed spaced aligned ramp plate 90 and the ramp mating member 130 having therebetween the portion of the flange member 86 having its opposed peripheral edges 100 and 102 in contact with the first elongated means 94 and the second elongated means 134, respectively. The sloping walls 154 and 156 have a bearing surface formed of a bearing material 160 and 162, respectively, formed thereon. The bearing material is formed of a brass and is adapted to be lubricated to permit slidable movement between the spaced opposed sloping walls 154 and 156 and the communicating outer surfaces 96 of the ramp plate 90 and outer surface 140 of the ramp mating member 130. The spaced opposed sloping walls 154 and 156 of the jaw assembly member 150 are substantially parallel to and slidably engage the outer surfaces 96 and 140, respectively. The jaw assembly member 150 is responsive to a thrust force applied thereto at the end thereof contiguous the opposed small ends 110 and 142 of the ramp plate 90 and ramp mating member 130, respectively, and, which thrust force, is in a direction substantially parallel the opposed peripheral edges 100 and 102 of the flanged member 86 to urge the bearing surfaces 160 and 162 defining the cavity against the outer surface 96 of ramp plate 90 and surface 140 of ramp mating member 130 applying a clamping force thereto causing the first elongated means 94 and the second elongated means 134, respectively, to securely grip the opposed peripheral edges 100 and 102, respectively, during application of the thrust force. The gripping action holds the releasable clamping assembly 34 at a fixed position against the pair of opposed peripheral edges 100 and 102 of the flanged member 86. The thrust force is reacted through the releasable clamping assembly 34 into the I-beam 24 in order to enable the jacking cylinder 30 (shown in FIGS. 1 and 2) to move the heavy load 22. In the preferred embodiment, the preselected angle is about 9.5°, which is a slope of about 1 to 6.

Referring to FIGS. 1 and 2, when the jacking cylinder 30 is hydraulically actuated to extend, pushing the heavy load 22, the reaction load enters releasable clamping assembly 34 through thrust plate 72 where it is equally divided between two jaw assemblies 150. Thrust load enters each jaw assembly 150 through a spherical joint 166 between thrust plate 72 and jaw assemblies 150. The working surfaces of jaw assemblies 150 are lined with bearing material 162 and 166 and lubricant. Under load from jacking cylinder 30, the jaw assemblies 150 move slightly away from the heavy load 22. Jaw assemblies 150 movement occurs along bearing surface 160 of ramp plate 90 and along bearing surface 162 of ramp mating member 134. The movement applies a clamping force onto ramp plate 90 and ramp mating member 134 causing the same to move towards one another. The flange contacting surface of ramp plate 90 and the flange contacting surface of each ramp mating member 134 utilize hardened serrated inserts, called "dies" as the first elongated means 94 and the second elongated means 134 engage the peripheral edges 100 and 102 of I-beam 24.

The dies engage the flange 86 of I-beam 24 with slight penetration preventing the releasable clamping assembly 34 from slipping during the application of the thrust force. The dies are of standard manufacture for similar use with various tools found on offshore oil platforms. For specialized applications the first elongated means 94 and the second elongated means may be smooth shoes. However, common use of dies demonstrates that the slight surface brinelling caused by serrated dies is not detrimental for most uses.

FIGS. 3 and 4 show that a slot 169 can be formed into the ramp plate 90 to receive a tab 170 formed as an extension of the ramp mating member such as to permit the ramp plate 90 to move toward or away from ramp mating member 130 while preventing relative motion of the two members in either direction of the jacking cylinder stroke of jacking cylinder 30. Such interlocking of the ramp plate 90 and the ramp mating member forces all the dies forming the elongated means 94 and 134, to clamp unison.

Referring to FIG. 1, tie rods 174 with nuts 178 join thrust plate 72 with tow bar 180 so that when jacking cylinder 30 is hydraulically retracted, the releasable clamping assembly 34 will be advanced along I-beam 22 by towing link 182 which engages the releasable clamping assembly 34 in tension with jacking cylinder 30 through eye bolt assembly 184. This is shown in detail in FIG. 5.

Figure 5:
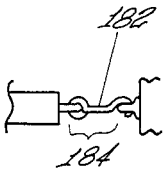
FIG. 5 is a sectional view taken along section lines 5—5 of FIG. 1.

As shown in FIGS. 1 and 5, the pulling motion by towing link 182 releases the ramp plate 90 and the ramp mating member 130 from I-beam 24 which were placed in gripping engagement by the pushing motion. Spring 186, loaded against plunger 188, keeps a light clamping pressure on the releasable clamping assembly 34 during towing and serves to initiate the locking action at the beginning of subsequent clamping as the next push stroke begins.

To change the releasable clamping assembly 34 from pushing the heavy load 22 to pulling the heavy load 22, the releasable clamping assembly 34 is dismantled and re-assembled in alternate position 88. Each component is sufficiently light in weight to be handled by one mechanic. Relocation can be accomplished in a few minutes. Total weight of the releasable clamping assembly 34 is about one fifth of the weight of a comparable hydraulic clamping assemblies in current use by the industry and a corresponding manufacturing cost of about one half.

A large rotational force couple exists in the combined structure of jacking cylinder 30 and releasable clamping assembly 34. It is caused by two eccentric opposed forces; namely, the jacking thrust which occurs in the plane of the jacking cylinder 30 axis and the reaction thrust which resists the jacking thrust and the reaction thrust occurs in the plane of the I-beam flange 86, the two planes being several inches apart. The jacking cylinder may be designed to have sufficient structure including using larger piston rod diameters to resist the rotational couple force.

Figure 6:
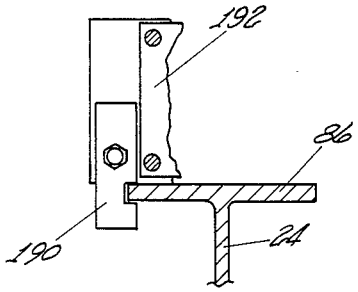
FIG. 6 is a partial sectional veiw taken along section lines 6—6 of FIG. 1.

As an alternative, FIG. 6 shows the use of a guide lug 190 which is used to resist the larger portion of the rotational force couple through the jacking cylinder 30 structure which permits using a smaller jacking cylinder. The jacking cylinder structure 192 is stabilized on the flange 86 of I-beam 24 by the guide lugs 190. These guide lugs 190 are mounted near the ends of jacking cylinder 30, having sufficient longitudinal span to resist the rotational force couple without imposing large loads on the I-beam flange 86. The smaller portion of the rotational force couple is resisted by the releasable clamping assembly 34 having sufficient longitudinal span to resist the couple without over-stressing the I-beam flange 86. The rotational force couple resisted by the releasable clamping assembly 34 is a function of the load and the distance between the center plane of thrust plate 72 and the plane of the I-beam flange 86 of I-beam 22.

Currently known hydraulic clamping assemblies and latching assemblies can be used advantageously with the combination of such guide lugs and jacking cylinder structure 192 to reduce the inherent rotational force couple and which permits the use of standard jacking cylinder and smaller thrust force reacting means. Consequently, the known hydraulic clamping assemblies utilize a design configuration which results in a clamp length several times the length possible in this embodiment.

As shown in FIGS. 1 and 2, rod clevis 60 is joined to the load through the connecting link 62 by connecting pins 64. The connecting link 62 and connecting pins 64 are designed for slight universal movement to accomodate slight horizontal and vertical misalignments between the axis of jacking cylinder 30 and the center line of I-beam 24.

Figure 7:
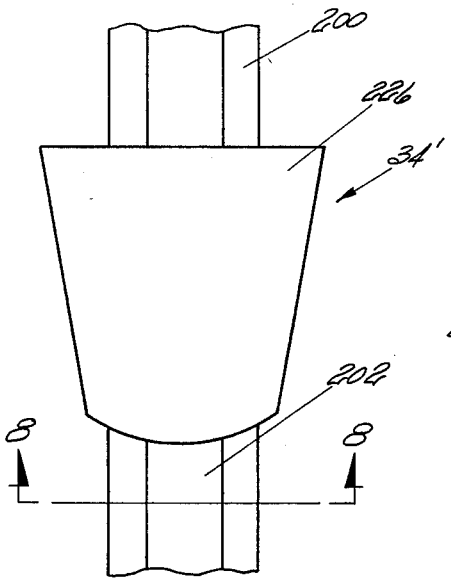
FIG. 7 is a top plan view of a releasable clamping assembly of the present invention for clamping side peripheral edges of a railroad rail.
Figure 8:
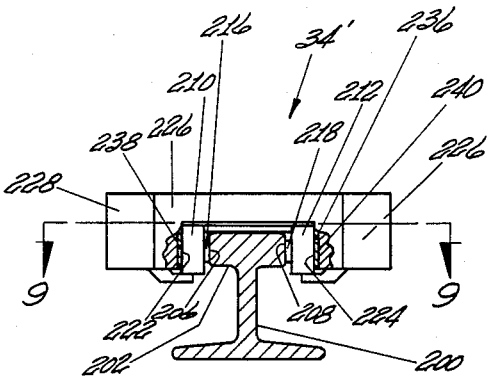
FIG. 8 is a sectional view taken along section lines 8—8 of FIG. 7.
Figure 9:
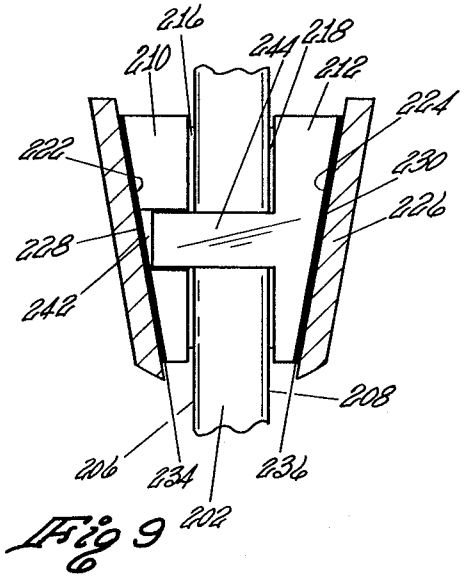
FIG. 9 is a sectional view taken along section lines 9—9 of FIG. 8.
Figure 13:
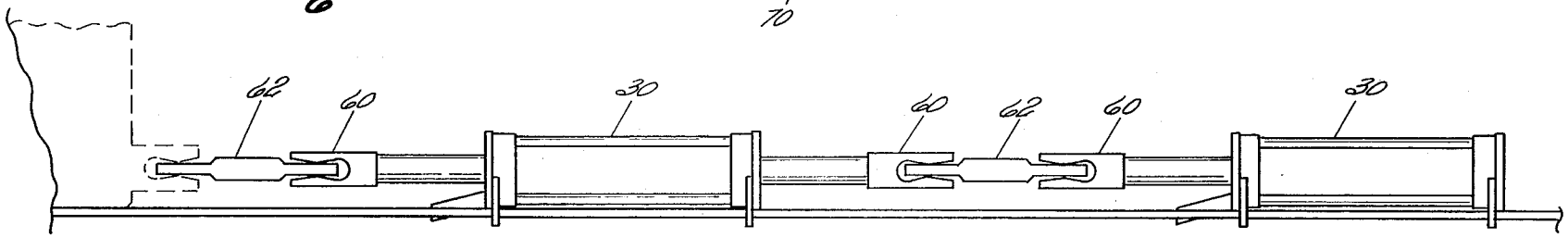
FIG. 13 shows one method in which two or more jacking cylinders can be cascaded to produce a thrust force greater than that produced by one jacking cylinder.

FIGS. 7, 8 and 9 show an alternate embodiment of a releasable clamping assembly 34'. The embodiment illustrated in FIGS. 7, 8 and 9 is adapted to clamp to a railroad rail 200 having a flanged member 202 which has peripheral edges 206 and 208. The releasable clamping assembly 34' includes a ramp plate 210, a first elongated means 216 located along one surface thereof which is adjacent the one peripheral edge 206, and a second opposed outer surface 222. The first elongated means 216 engages the one peripheral edge 202.

A ramp mating member 212 is positioned in aligned opposed relationship with the ramp plate 210. The ramp mating member 212 has a second elongated means 218 which is adapted to engage the other peripheral edge 218. The ramp mating member 212 has an opposed outer surface 224. The ramp plate 210 and the ramp mating member 212 have their opposed sloping outer surfaces extending at a preselected angle relative to the elongated means to form wedges having a small end and a large end in the same manner as was discussed in connection with FIG. 3. The ramp plate 210 and the ramp mating member 212 are adapted to be positioned relative to the edges of the rail 206 and 208 with the first elongated means 216 in contact with the one peripheral edge 202 and the second elongated means 218 in contact with the other peripheral edge 208. The small end of the ramp plate 210 and the small end of the ramp mating member 212 are positioned in opposed spaced alignment relative to each other with the corresponding large ends thereof positioned in opposed spaced alignment relative to each other and are adapted to be responsive to a clamping force concurrently applied to the respective outer surfaces to securely grip its associated peripheral edge in the manner described hereinbefore in connection with FIGS. 2 through 5, inclusive.

The releasable clamping assembly 34' includes a jaw assembly 226 which includes means for defining a cavity in the center thereof in terms of opposed spaced sloping walls 234 which is adjacent the outer surface 22 of ramp plate 210 and the other sloping wall 236 which is adjacent the outer surface 224.

The cavity defined by the opposed sloping walls 234 and 236 is adapted to receive the opposed spaced aligned ramp plate 210 and ramp mating member 212 which has therebetween that portion of the flange member 202 having its opposed peripheral edges 206 and 208 in contact with the first elongated means 216 and the second elongated means 218, respectively. The jaw assembly 226 and sloping walls 234 and 236 each have a bearing material 238 and 240, respectively, formed thereon and the spaced opposed sloping walls 234 and 236 are substantially parallel to and slidably engage the outer surfaces 222 of ramp plate 210 and outer surface 224 of the ramp mating member 212.

As illustrated in FIG. 9, the ramp plate 210 may include a slot 242 which is adapted to cooperate with a tab 244 formed as an extended member from the ramp mating member 212. The purpose of the slot 242 and tab 244 arrangement is substantially for the same purpose as discussed in connection with FIG. 4.

Figure 10:
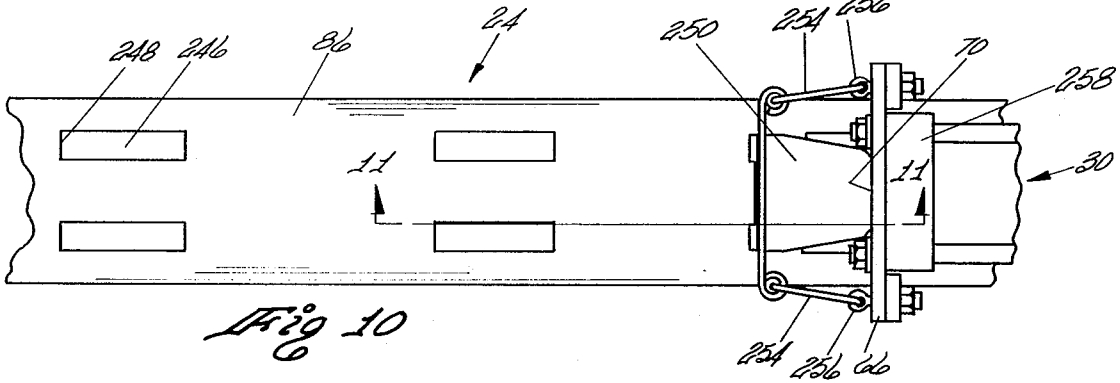
FIG. 10 shows an alternative arrangement to FIG. 1 using load translating means and a latching mechanism.

FIG. 10 shows an alternative arrangement to FIG. 1 wherein the I-beam flange 86, is perforated or preformed with pairs of regularly spaced rectangular slots 246 with end faces 248 and having a pitch distance between slot pairs of slightly less than the full stroke of jacking cylinder 30. In lieu of releasable clamping assembly 34 is a latch assembly 250, one end of which fits into the arcuate shaped recess 70 of flange 60 and the other end of which can bear against the end faces 248 of slots 246. Latch assembly 250 has an integral towing bar 254 and towing links 256 identical to those employed on releasable clamp assembly 34 and as shown in FIG. 5. The towing links 256 engage the jacking cylinder assembly 258 through eye bolts 246 permitting the jacking cylinder 30, when retracting, to advance the latch assembly 53 along I-beam 13. The use of guide lugs 190 permit the use of a latching assembly in combination with a jacking cylinder.

Figure 11:
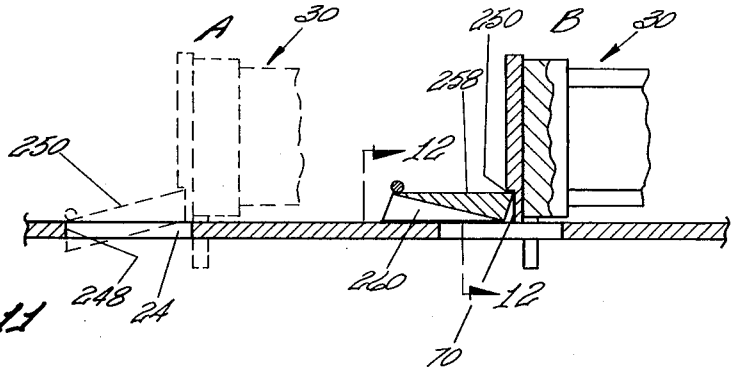
FIG. 11 is a partial sectional view taken along section lines 11—11 of FIG. 10.

FIG. 11 illustrates jacking cylinder 30 in phantom lines, position "A", wherein latch assembly 250 is engaged to react the load from jacking cylinder 30. Jacking cylinder 30, shown by solid lines in position "B" corresponds to the jacking cylinder 30 position shown in FIG. 10 wherein the latch assembly 250 is being dragged along I-beam 24 on its way to the next pair of slots 246.

Figure 12:
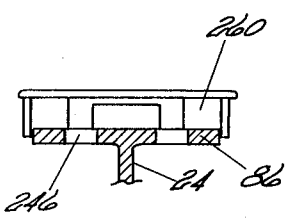
FIG. 12 is a partial sectional view taken along section lines 12—12 of FIG. 11.

FIG. 11 illustrates the jacking cylinder 30 being advanced into a different position. FIG. 12 shows the recessed underside configuration of the latch body 258, flanked by integral lugs 260 which, when engaged, project downward into slots 246.

The latch assembly 250 is light in weight and can be quickly removed by hand from the blind-end location of the jacking cylinder 30 and re-installed at the equivalent rod-end location to reverse the direction of travel.

Because the latch body 250 exhibits an externally radiused surface which mates with the arcuate shaped recess 70, the latch assembly 250 is free to pivot slightly about a vertical axis to accomodate misalignment of jacking cylinder 30 with axis of I-beam 24 or to accomodate mislocation of end face 244 of slots 246. The slots 246 are normally flame cut rather than machined and for cost saving purposes may have significant dimensional tolerance on their location relative to one another.

FIG. 12 shows one of several possible methods in which the jacking cylinder 30 can be configured to be joined to function in unison. In this cascaded arrangement, the jacking forces from a multiple number of jacking cylinders can be accumulated to apply very large jacking forces against the load. The forces are collected in the piston rods of the jacking cylinders eliminating the need for a sled structure as described in U.S. Pat. No. 4,007,915.

Thus a hydraulic jacking machine has been disclosed for moving a heavy load along an I-beam through the combination of hydraulic jacking cylinders in cooperation with a releasable clamping assembly.

Although the present invention has been disclosed and illustrated with reference to particular applications, the principles involved are susceptible to numerous other applications which will be apparent to persons skilled in the art. The invention therefore is to be limited only as indicated by the scope of the appended claims.

What is claimed is:

1. A hydraulic apparatus for moving a heavy load along a flanged member comprising a hydraulic jacking cylinder;

clamping means operatively coupled to said hydraulic jacking cylinder for reacting the thrust force of the hydraulic jacking cylinder to the flanged member to advance the heavy load along the flanged member, said clamping means having a jaw member having a channel-shaped cavity having opposed sloping walls forming a bearing surface; and a ramp member and a ramp mating member positioned in opposed spaced relationship and having opposed sloping walls which are adapted to slidably engage said bearing surface, said jaw member being adapted to receive said thrust from said jacking cylinder and reacting in response thereto to apply a clamping onto and urging said ramp plate and said ramp mating member toward each other to grip the flange and arrest the motion of the jacking cylinder relative to the flanged member; and a plurality of load path members for transmitting the rotational force couple from the jacking cylinder directly to the flange such that a very small thrust load in the direction of travel applied to the clamping means will permit the opposed aligned ramp plate and the ramp mating member to move toward each other gripping the flanged member.

2. The hydraulic apparatus of claim 1 wherein the flanged member is an I-beam and the direction of travel along the I-beam is reversable by repositioning the thrust force reacting means from one end of the jacking cylinder to the opposite end.

3. The hydraulic apparatus of claim 1 wherein jacking cylinders can be joined axially in tandem for the purpose of collecting load from two or more jacking cylinders to increase jacking force.

4. The hydraulic apparatus of claim 1 wherein said bearing surfaces formed on the opposed sloping walls comprise a separate bearing material affixed to the jaw member.

5. A hydraulic apparatus for moving a heavy load along an I-beam shaped structural member having a flange comprising a double-action hydraulic jacking cylinder;

a clamping assembly having a jaw member having a channel-shaped cavity having opposed sloping walls forming a bearing surface;

a ramp member and a ramp mating member positioned in opposed spaced relationship and having opposed sloping walls which are adapted to slidably engage said bearing surface, said jaw member being adapted to receive said thrust from said jacking cylinder and reacting in response thereto to apply a clamping force onto and urging said ramp plate and said ramp mating member toward each other to grip the flange and arrest the motion of the jacking cylinder relative to the I-beam;

means for operatively coupling said clamping assembly to said hydraulic jacking cylinder for transmitting said thrust load to the clamping assembly; and towing link means for applying a small thrust force in the direction of travel of a heavy load onto the jaw member which permits the ramp plate and ramp mating member to move apart allowing the jacking cylinder with the releasable clamping assembly to advance.

6. A hydraulic apparatus for moving a heavy load along an I-beam shaped structural member having a flange comprising a hydraulic jacking cylinder;

a clamping assembly having a jaw member having a channel-shaped cavity having opposed sloping walls forming a bearing surface;

a ramp member and a ramp mating member positioned in opposed spaced relationship and having opposed sloping walls which are adapted to slidably engage said bearing surface, said jaw member being adapted to receive said thrust from said jacking cylinder and reacting in response thereto to apply a clamping force onto and urging said ramp plate and said ramp mating member toward each other to grip the flange and arrest the motion of the jacking cylinder relative to the I-beam; and means for operatively coupling said clamping assembly to one end of said hydraulic jacking cylinder for transmitting said thrust load to the clamping assembly wherein the direction of movement along the I-beam is in a first direction and wherein the direction of travel along the I-beam is reversible by repositioning the clamping assembly from said one end of the jacking cylinder to the opposite end.

* * * * *